US009394899B2

(12) United States Patent
Garvey et al.

(10) Patent No.: US 9,394,899 B2
(45) Date of Patent: Jul. 19, 2016

(54) SYSTEM AND METHOD FOR FAULT DETECTION IN AN ELECTRICAL DEVICE

(71) Applicant: General Electric Company, Schenectady, NY (US)

(72) Inventors: Dustin Ross Garvey, Oakland, CA (US); Scott Charles Evans, Burnt Hills, NY (US); Bing Hu, Riverside, CA (US)

(73) Assignee: General Electric Company, Niskayuna, NY (US)

( * ) Notice: Subject to any disclaimer, the term of this patent is extended or adjusted under 35 U.S.C. 154(b) by 409 days.

(21) Appl. No.: 14/105,819

(22) Filed: Dec. 13, 2013

(65) Prior Publication Data

US 2015/0167661 A1 Jun. 18, 2015

(51) Int. Cl.

| | |
|---|---|
| ***G06F 11/30*** | (2006.01) |
| ***F04B 51/00*** | (2006.01) |
| ***E21B 43/12*** | (2006.01) |
| ***F04B 47/06*** | (2006.01) |
| ***F04B 49/06*** | (2006.01) |

(52) U.S. Cl.

CPC ..... *F04B 51/00* (2013.01); *E21B 43/128* (2013.01); *F04B 47/06* (2013.01); *F04B 49/065* (2013.01); *F04B 2201/0802* (2013.01); *F04B 2203/0201* (2013.01); *F04B 2203/0202* (2013.01); *F04B 2205/05* (2013.01)

(58) Field of Classification Search

CPC .... F04B 51/00; F04B 49/065; E21B 47/0007; F04D 13/10; G05B 23/0283; G05B 23/0221; G05B 15/02

See application file for complete search history.

(56) References Cited

U.S. PATENT DOCUMENTS

| | | | | |
|---|---|---|---|---|
| 4,642,782 | A | 2/1987 | Kemper et al. | |
| 7,028,543 | B2 | 4/2006 | Hardage et al. | |
| 7,720,639 | B2 | 5/2010 | Kirchner et al. | |
| 7,979,240 | B2 | 7/2011 | Fielder | |
| 8,141,646 | B2 * | 3/2012 | Allen | E21B 43/128 166/105 |

(Continued)

FOREIGN PATENT DOCUMENTS

WO 2008152376 A1 12/2008

OTHER PUBLICATIONS

Halliburton, "Artificial Lift Remote Monitoring and Control Software",Product Brochure, Halliburton, H010420 Nov. 2013, 4 Pages.

(Continued)

*Primary Examiner* — An Do
(74) *Attorney, Agent, or Firm* — Andrew J. Caruso

(57) ABSTRACT

A method for fault detection includes selecting a measured parameter from a subsurface electrical device and obtaining a plurality of samples for the measured parameter. The method also includes removing at least one invalid sample from the plurality of samples to generate a remaining number of samples. The method further includes computing a diagnostic parameter based on the remaining number of samples, if the remaining number of samples is greater than a predefined threshold number and terminating the method otherwise. The method also includes obtaining a rule from a plurality of rules stored in a database, based on the diagnostic parameter. The rule is indicative of a standard operating condition of the subsurface electrical device. The method further includes evaluating whether the determined diagnostic parameter satisfies the obtained rule, to generate an output and determining a measured operating condition of the subsurface electrical device based on the output.

21 Claims, 9 Drawing Sheets

(56) References Cited

U.S. PATENT DOCUMENTS

| | | | | |
|---|---|---|---|---|
| 8,296,104 | B2 | 10/2012 | Ramacher et al. | |
| 8,746,353 | B2 * | 6/2014 | Forsberg | E21B 43/128 166/105 |
| 2006/0064291 | A1 | 3/2006 | Pattipatti et al. | |
| 2008/0187444 | A1 | 8/2008 | Molotkov et al. | |
| 2010/0047089 | A1 | 2/2010 | Booker et al. | |

OTHER PUBLICATIONS

"WellSavvyTM Artificial Lift, Real-Time Diagnostic Software", Product Brochure, Weatherford, 2009, 4 Pages.

Keogh et al., "An Online Algorithm for Segmenting Time Series", Data Mining, 2001. ICDM 2001, Proceedings IEEE International Conference, 2001, pp. 289-296.

"Gas Turbine Remote Monitoring and Diagnostics", Diesel & Gas Turbine Worldwide, Apr. 2003, 2 pages.

Eklund et al., "Multi-Scale Rank-Permutation Change Localization", Aerospace Conference, 2007 IEEE, pp. 1-7, Mar. 2007.

Feng et al., "The Diagnosis Research of Electric Submersible Pump Based on Neural Network", The Sixth International Symposium on Neural Networks (ISNN 2009), vol. 56, May 2009, pp. 721-727.

Hu et al., "Discovering the Intrinsic Cardinality and Dimensionality of Time Series using MDL", 11th IEEE International Conference on Data Mining (ICDM), 2011, pp. 1086-1091.

Case History:"Xpvision Software Prevented 63 Esp Failures in West Texas Field Trial", Baker Hughes, 2012.

* cited by examiner

SYSTEM AND METHOD FOR FAULT DETECTION IN AN ELECTRICAL DEVICE

BACKGROUND

The subject matter disclosed herein is related to electrical devices, for example, Electrical Submersible Pumps (ESP). More specifically, the subject matter relates to methods and systems for detecting faults in electrical devices.

An ESP includes an electrical motor installed in a subsurface well. Conventionally, the ESP is operated continuously till the failure of the electrical motor occurs, as the repair or replacement of the electrical motor necessitates costly interruption of operation of the ESP. Monitoring of ESP for diagnostic purposes enables some level of scheduling of preventive maintenance.

In a traditional approach, an accelerometer may be positioned in the subsurface well to measure acceleration of the motor at a relatively rapid sample rate. The accelerometer data may be analyzed to provide advance warning of potential failure of a component of the motor, such as bearing failure.

Although motors may be monitored using an accelerometer, such an approach in monitoring ESP located in remote locations is not optimal. Such conventional approaches provide limited bandwidth for transmission of a high sample rate data from the accelerometer.

Thus, there is a need for an enhanced system and method for remote monitoring and diagnostics of an electrical device such as an ESP.

BRIEF DESCRIPTION

In accordance with one aspect of the present invention, a method is disclosed. The method includes selecting a measured parameter from a sensor coupled to a subsurface electrical device and obtaining a plurality of samples for the measured parameter. The method also includes removing at least one invalid sample from the plurality of samples of the measured parameter to generate a remaining number of samples. The invalid sample is based on a predefined sample criteria. The method further includes computing a diagnostic parameter based on the remaining number of samples from the plurality of samples, if the remaining number of samples is greater than a predefined threshold number and terminating the method otherwise. The method also includes obtaining a rule from a plurality of rules stored in a database, based on the diagnostic parameter. The rule is indicative of a standard operating condition of the subsurface electrical device. The method further includes evaluating whether the determined diagnostic parameter satisfies the obtained rule, to generate an output. The method also includes determining a measured operating condition of the subsurface electrical device based on the output.

In accordance with another aspect of the present invention, a system is disclosed. The system includes at least one processor and a memory communicatively coupled to the at least one processor. The system also includes a database having a plurality of rules, stored in the memory. The rule is indicative of a standard operating condition of a subsurface electrical device. The system further includes an analytic engine stored in the memory and executable by the at least one processor and configured to select a measured parameter from a sensor coupled to the subsurface electrical device. The analytic engine is also configured to obtain a plurality of samples for the measured parameter. The analytic engine is further configured to remove at least one invalid sample from the plurality of samples based on a predefined sample criteria to generate a remaining number of samples. The analytic engine is configured to compute a diagnostic parameter based on the remaining number of samples from the plurality of samples, when the remaining number of is greater than a predefined threshold number and to terminate the execution by the at least one processor otherwise. The analytic engine is further configured to obtain a rule from the plurality of rules stored in the database, based on the diagnostic parameter and to evaluate whether the determined diagnostic parameter satisfies the obtained rule, to generate an output. The analytic engine is also configured to determine a measured operating condition of the subsurface electrical device based on the output.

In accordance with another aspect of the present invention, a non-transitory computer readable medium encoded with a program to instruct at least one processor to determine a measured operating condition of the subsurface electrical device is disclosed. The program instructs the at least one processor to select a measured parameter from a sensor coupled to a subsurface electrical device and obtain a plurality of samples for the measured parameter. The program also instructs the at least one processor to remove at least one invalid sample from the plurality of samples of the measured parameter to generate a remaining number of samples. The invalid sample is based on a predefined criteria. The program further instructs the at least one processor to compute a diagnostic parameter based on the remaining number of samples from the plurality of samples, if the remaining number of samples is greater than a predefined threshold number and to terminate the program otherwise. The program instructs the at least one processor to obtain a rule from a plurality of rules stored in a database, based on the diagnostic parameter. The rule is indicative of a standard operating condition of the subsurface electrical device. The program further instructs the at least one processor to evaluate whether the determined diagnostic parameter satisfies the obtained rule, to generate an output. The program also instructs the at least one processor to determine a measured operating condition of the subsurface electrical device based on the output.

DRAWINGS

These and other features and aspects of embodiments of the present invention will become better understood when the following detailed description is read with reference to the accompanying drawings in which like characters represent like parts throughout the drawings, wherein.

DETAILED DESCRIPTION

Embodiments herein disclose systems and methods for determining a measured operating condition of an electrical device such as an electrical submersible pump (ESP). An exemplary method involves receiving a measured parameter from a sensor coupled to an electrical device and determining at least one diagnostic parameter based on the measured parameter. A rule from a plurality of rules stored in a database, is obtained based on the diagnostic parameter. The obtained rule is indicative of a standard operating condition of the electrical device. The rule is evaluated by verifying if the determined diagnostic parameter satisfies the obtained rule and an output is generated accordingly. The measured operating condition of the electrical device is determined based on the generated output.

Figure 1:
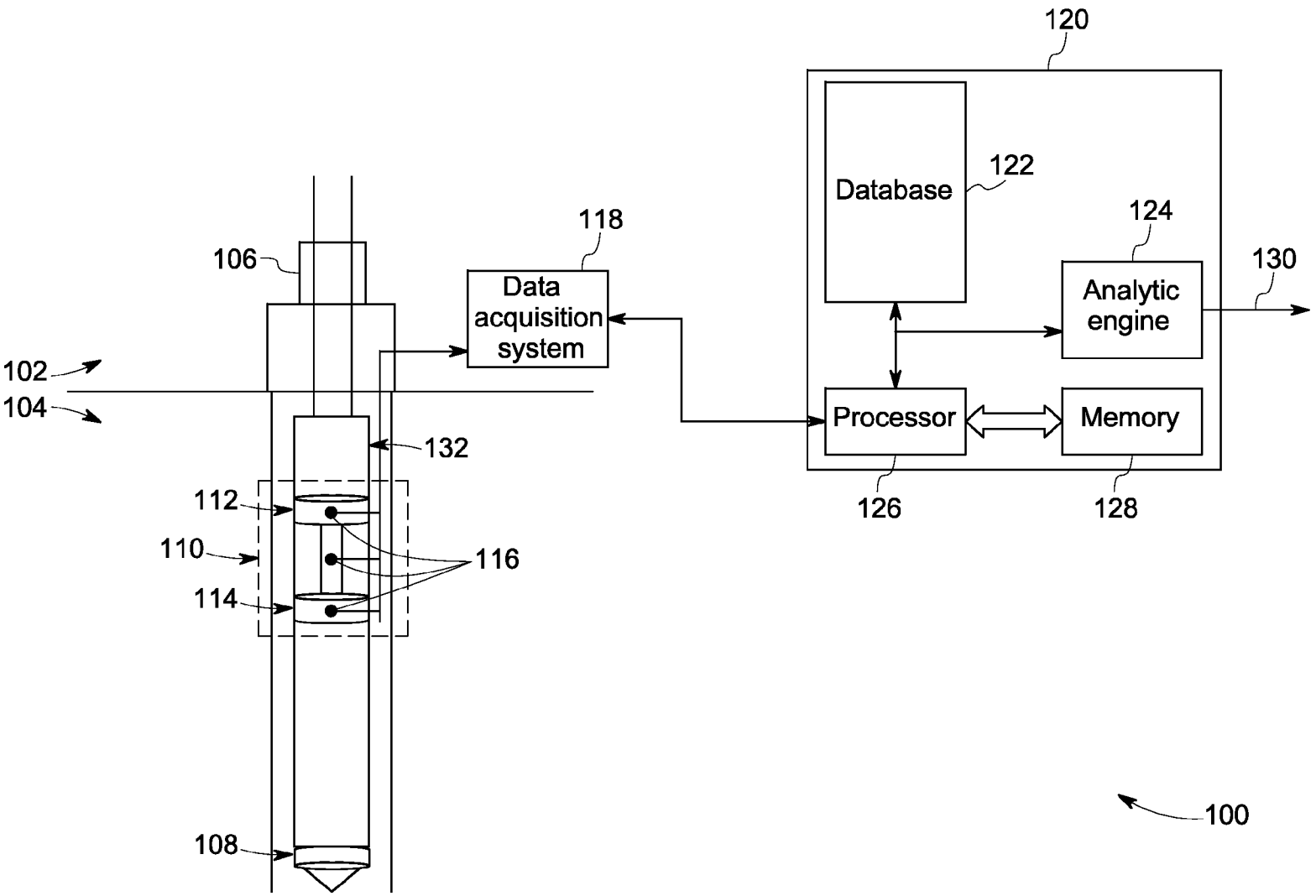
FIG. 1 is a schematic block diagram of a system for determining a measured operating condition of an electrical device in accordance with an exemplary embodiment.

FIG. 1 is a diagrammatic illustration of an oil extraction system 100 having an electrical device 110 in accordance with an exemplary embodiment. In the illustrated embodiment, the electrical device 110 is an electrical submersible pump (ESP) located at a well 104 located at depths up to 12000 feet, for example. The electrical device 110 includes an electrical motor 114 and a centrifugal pump 112. The electrical motor 114 drives the centrifugal pump 112 to provide artificial lift for a fluid disposed in a well 108. A plurality of sensors 116 are disposed on the electrical motor 114 and the pump 112 to measure a number of parameters such as those associated with the electrical device 110 as well as the environmental conditions and other aspects of the well operations. The measured parameters are transmitted from the plurality of sensors 116 via a plurality of communication cables 132 extending through a well head 106 disposed at a well surface 102.

A data acquisition system 118 receives the plurality of measured parameters from the sensors 116 and transmits the measured parameters to a fault detection system 120 for determination of a measured operating condition of the electrical device 110. The fault detection system 120, in one example, includes a database 122, an analytic engine 124, a processor 126, and a memory 128. The fault detection system 120 is configured to process the measured parameters and determine a measured operating condition 130 of the electrical device 110. It should be noted herein that the measured operating condition 130 of the electrical device 110 is representative of a fault or a symptom of generation of a fault.

The database 122 includes a plurality of rules, each rule is indicative of a standard operating condition of the electrical device 110. The rules, in one example, are derived from historical data acquired from the plurality of sensors 116. The rules, in another example, include design specification and simulation data. The database 122 may store a plurality of rules corresponding to one standard operating condition of the electrical device 110. The database 122 further includes a plurality of rules for determining a plurality of measured operating conditions of the electrical device 110. Each rule stored in the database 122 may be in the form of a set of comparative statements. Each comparative statement may use one or more diagnostic parameter derived from the measured parameters. The comparative statement may also use one or more threshold values for comparative purpose. New rules may be added to the database 122 to determine additional operating conditions of the electrical device 110. For example, excessive vibration condition may be due to a number of fault conditions such as impeller erosion, coupling problems, and seal leaks. A rule for determining an excessive vibration is disclosed herein. A new rule to detect impeller erosion may be included to the database and such a rule is then evaluated when the excessive vibration condition is detected.

In one embodiment, the database 122 may be stored in a single memory module at one location. In other embodiments, the database 122 may be stored in a plurality of memory modules in a distributed manner. The database 122 may be at least one of a SQL database, an Oracle database, and a MySQL database. In alternate embodiments, other types of databases including relationship database systems (RDBS) may be used to store the plurality of rules. It may be noted herein that in one embodiment, the database 122 is a customized database. In other embodiments, the database 122 may be an off-the-shelf database.

The analytic engine 124 is communicatively coupled to the database 122. The analytic engine 124 may be stored in the memory 128 and executable by at least one processor 126. In an alternate embodiment, the analytic engine 124 may also be a specialized hardware such as FPGA. The analytic engine 124 processes the measured parameters and computes one or more diagnostic parameters based on the measured parameters. The diagnostic parameter may be a statistical parameter or a derived parameter from the measured parameter. In one implementation, the analytic engine 124 receives a rule from the database 122 and evaluates the determined diagnostic parameter to verify if the obtained rule is satisfied. The evaluation generates an output which may be a binary value. For example, if the rule is satisfied by the determined diagnostic parameter, the generated output is equal to "1" and if the rule is not satisfied by the determined diagnostic parameter, the generated output is equal to "0". In an alternate embodiment, if the rule is satisfied by the determined diagnostic parameter, the output is a "YES" representative of a binary positive. In the same embodiment, if the rule is not satisfied by the determined diagnostic parameter, the output is a "NO" representative of a binary negative.

The processor 126 is communicatively coupled to the database 122 and the analytic engine 124. The processor 126 may include at least one arithmetic logic unit, microprocessor, general purpose controller, or other processor arrays to perform the desired computations. In one embodiment, the processor 126 is a custom hardware configured to perform functions of the analytic engine 124 and the data acquisition system 118. In another embodiment, the processor 126 is a digital signal processor or a microcontroller. The processor 126 may also be configured to manage the contents of the database 122. In some embodiments, other type of processors, operating systems, and physical configurations are envisioned.

The memory 128 is coupled to the processor 126 and may also be optionally coupled to the other modules 118, 122, 124. The memory 128 is configured to store instructions performed by the processor 126 and contents of the database 122. The memory 128 may be a non-transitory storage medium. For example, the memory 128 may be a dynamic random access memory (DRAM) device, a static random access memory (SRAM) device, flash memory or other memory devices. In one embodiment, the memory 128 may include a non-volatile memory or similar permanent storage device, and media such as a hard disk drive, a floppy disk drive, a compact disc read only memory (CD-ROM) device, a digital versatile disc read only memory (DVD-ROM) device, a digital versatile disc random access memory (DVD-RAM) device, a digital versatile disc rewritable (DVD-RW) device, a flash memory device, or other non-volatile storage devices. In one embodiment, the memory 128 may be communicatively coupled to the processor 126. In an alternate embodiment, the memory 128 is an on-board memory of the processor 126.

In an exemplary embodiment, the non-transitory computer readable medium encoded with a program, instructs the processor 126 to perform functions associated with the fault detection system 120 for determining the measured operating condition of the electrical device 110. The program instructions include one or more functions of the database 122, the analytic engine 124, and the data acquisition system 118.

Figure 2:
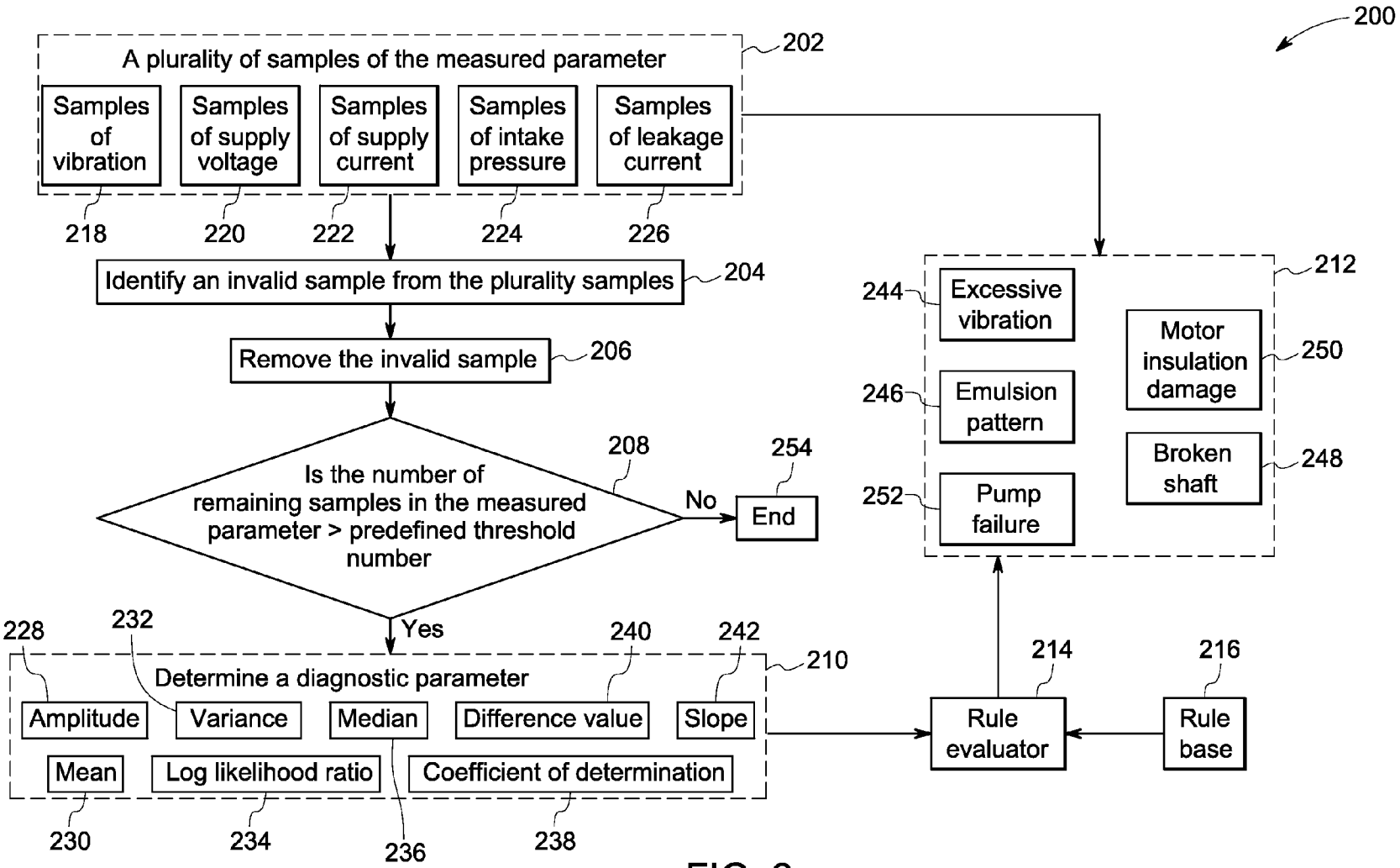
FIG. 2 is a schematic flow diagram illustrating processing of a plurality of measured parameters in accordance with an exemplary embodiment.

FIG. 2 is a schematic flow diagram 200 illustrating processing of a plurality of measured parameters in accordance with an exemplary embodiment. A plurality of samples of the measured parameter 202 are obtained from a plurality of sensors for processing various attributes of the well operations including the ESP. In an exemplary embodiment, the plurality of samples include, but not limited to, samples of vibration 218, supply voltage 220, supply current 222, intake pressure 224, and leakage current 226.

According to one embodiment, an invalid sample is identified 204 and removed 206 from the plurality samples of the measured parameter. The identification of an invalid sample may be based on a predefined sample criteria. In one example, the predefined sample criterion includes a parameter range or operating range. If a sample of the measured parameter is not within the parameter range, the corresponding sample is identified as an invalid sample. It should be noted herein that the parameter range for each measured parameter may be different and may be pre-defined based on the type of the measured parameter. In another example, the predefined sample criteria includes a not-a-number (NaN) condition. When a sample of the measured parameter is not-a-number, the corresponding sample is identified as an invalid sample. The invalid sample is then removed from the plurality of samples of the measured parameter 206.

The remaining number of samples from the plurality samples of the measured parameter is counted. The remaining number of samples of the measured parameter is then compared with a predefined threshold number 208. The predefined threshold number, in one example, is provided by a user. In another example, the predefined threshold number is initially set by a user but is then adjusted based on historical data so that enough samples are obtained for a good measurement. In a further example, if the remaining number of samples is greater than the predefined threshold number, further processing of the remaining number of samples is performed. In one example, the predefined threshold number is equal to thirty. If the remaining number of samples is less than the predefined threshold number, the processing is terminated 254. In another example, if the remaining number of samples is less than a predefined threshold number, the processing continues but the resulting value is noted as low confidence.

A diagnostic parameter is determined 210 based on the remaining number of samples obtained from the comparison is discussed herein. In one embodiment, the diagnostic parameter is a statistical parameter. For example, the statistical parameter may be a mean value 230 of a plurality of samples of the measured parameter. In another example, the statistical parameter may be a variance 232 of a plurality of samples of the measured parameter. In yet another example, other statistical parameters such as a log likelihood ratio 234, a median 236, a coefficient of determination 238 may be determined. In yet another example, diagnostic parameter is a derived parameter. For example, the derived parameter may be an amplitude of a plurality of samples of the measured parameters 228. In another example, the derived parameter may be a difference value 240 determined from a plurality of samples of the measured parameter. In yet another example, the derived parameter may be a slope 242 value of a plurality samples of the measured parameter.

In accordance with the embodiments of the present system, one or more diagnostic parameters may be determined based on each measured parameter. In one embodiment, an amplitude value of the vibration is determined. In another embodiment, a variance of the supply current is determined. In yet another embodiment, a log likelihood ratio based on the supply voltage, is determined. In yet another exemplary embodiment, a coefficient of determination based on the intake pressure is determined. In yet another embodiment, a median value of the leakage current is determined. In yet another embodiment, ESP properties are evaluated based on a plurality of diagnostic parameters of varying types. It should be noted herein that the aforementioned embodiments are exemplary in nature and should not be construed as limiting the scope of the invention.

A rule evaluator 214 receives a rule from a database 216, based on the diagnostic parameter. The obtained rule is indicative of a standard operating condition of the electrical device. The rule is evaluated by verifying if the determined diagnostic parameter satisfies the obtained rule and an output is generated accordingly. A measured operating condition of the electrical device is determined based on the generated output 212. In some embodiments, a plurality of measured operating conditions are determined. In one example, the measured operating condition of the electrical device is excessive vibration 244. In another example, the measured operating condition of the electrical device is an emulsion pattern 246. In yet another example, the measured operating condition of the electrical device is a broken shaft 248, motor insulation damage 250, or pump failure 252.

Figure 3:
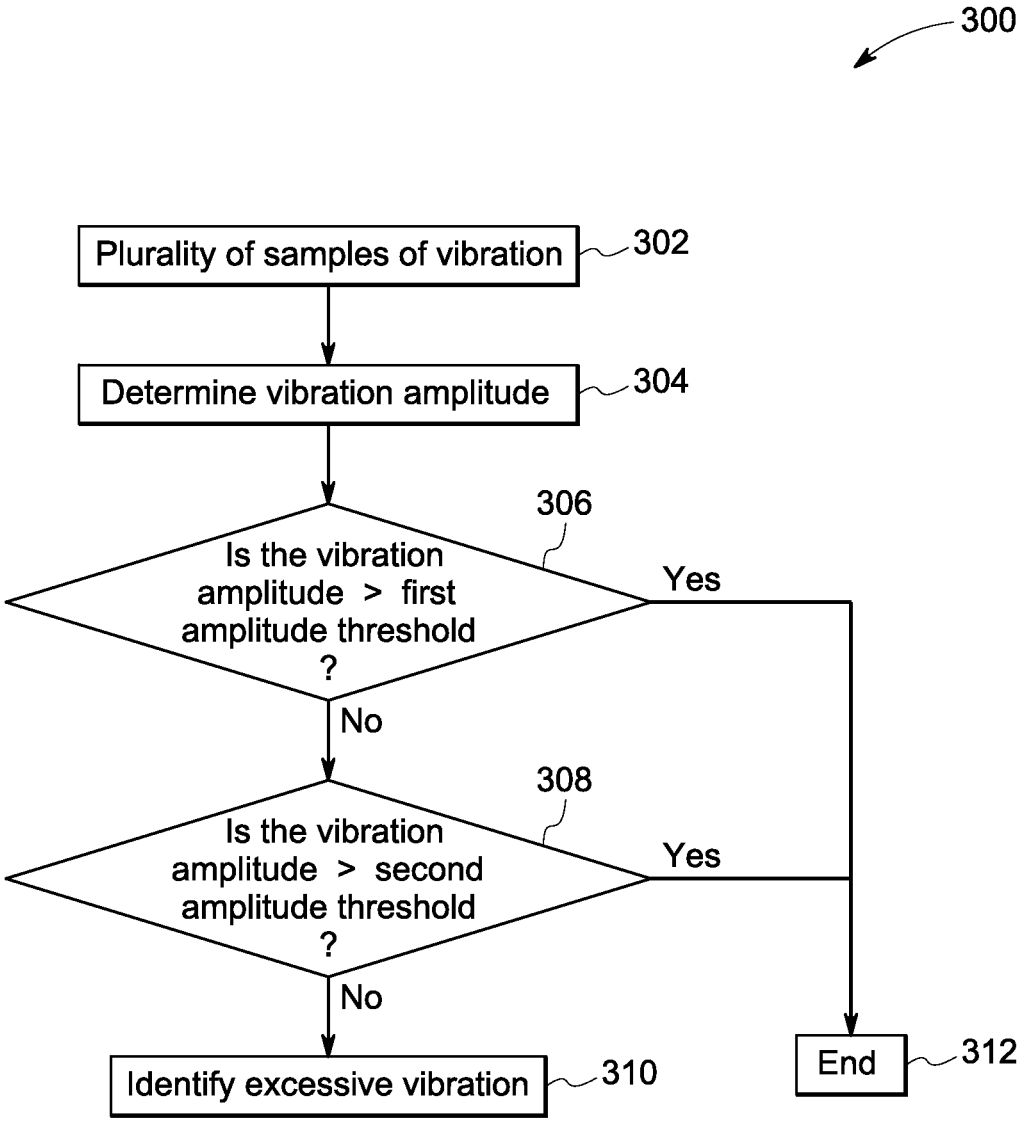
FIG. 3 is a flow chart illustrating a method for identification of an excessive vibration condition of an electrical device in accordance with an exemplary embodiment.

FIG. 3 is a flow chart 300 illustrating a method for identification of an excessive vibration condition of an electrical device in accordance with an exemplary embodiment. A plurality of samples of measured vibration is obtained from at least one sensor 302. Vibration amplitude is then determined 304 as a diagnostic parameter based on the plurality of samples. The vibration amplitude is compared with a first amplitude threshold 306. The first amplitude threshold is indicative of an upper limit of vibration. In one embodiment, the first amplitude threshold is 10 G. When the vibration amplitude is greater than the first amplitude threshold, the processing step is terminated 312 and hence the measured operating condition is not determined. When the vibration amplitude is less than the first amplitude threshold, the vibration amplitude is then compared with a second amplitude threshold 308.

The second amplitude threshold is representative of a lower limit of vibration. In one embodiment, the second amplitude threshold is 0.8 G. When the vibration amplitude is less than the second amplitude threshold, the processing is terminated 312 and hence the measured operating condition is not determined. When the vibration amplitude threshold is greater than the second amplitude threshold, the excessive vibration condition is determined 310.

Figure 4:
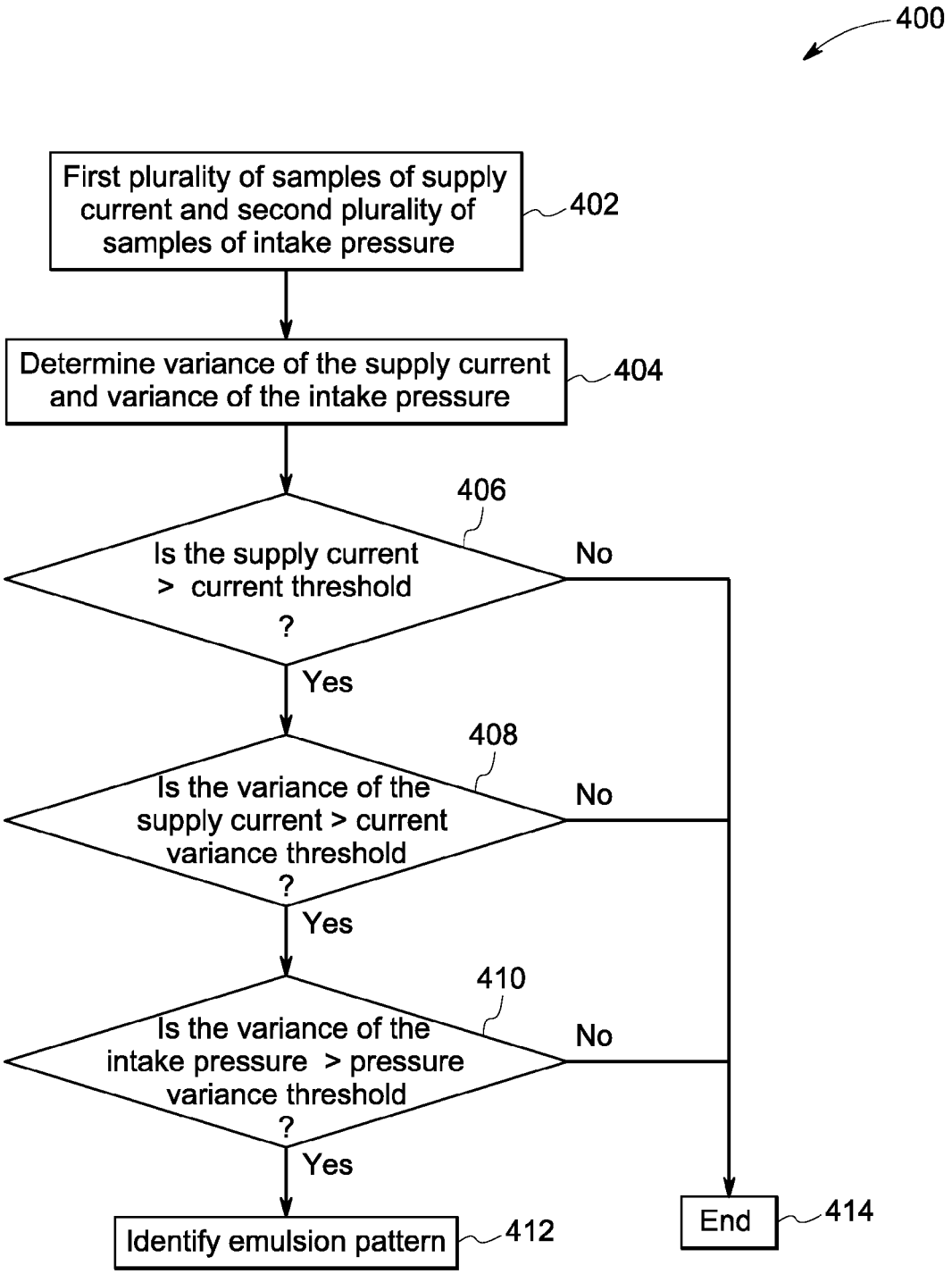
FIG. 4 is a flow chart illustrating a method for identification of an emulsion pattern of an electrical device in accordance with an exemplary embodiment.

FIG. 4 is a flow chart 400 illustrating a method for identification of an emulsion pattern of an electrical device in accordance with an exemplary embodiment. In this example, different types of sensors are utilized in the logic flow in order to arrive at the end result. A first plurality of samples of supply current and a second plurality of samples of intake pressure are obtained from a plurality of sensors 402. A variance of the supply current and a variance of the intake pressure are determined 404 as diagnostic parameters based on the first plurality of samples of the supply current and the second plurality of samples of intake pressure. The first plurality of samples of the supply current are compared with a current threshold 406 to verify if the centrifugal pump is switched off. If the first plurality of samples of the supply current are greater than the current threshold, the variance of the supply current is then compared with a current variance threshold 408. If the first plurality of samples of the supply current are less than or equal to the current threshold, the processing is terminated and hence the measured operating condition is not determined 414 since the centrifugal pump is switched off. In an exemplary embodiment, the current threshold is 15 A. When the variance of the supply current is greater than the current variance threshold, the variance of the intake pressure is compared with a pressure variance threshold 410, indicating that the centrifugal pump is switched on. When the variance of the intake pressure is greater than the pressure variance threshold, an emulsion pattern is determined 412. In an exemplary embodiment, the current variance threshold is 5 $A^2$, and the pressure variance threshold is 50 $Bar^2$. Otherwise, the processing is terminated and the measured operating condition is not determined 414.

Figure 5:
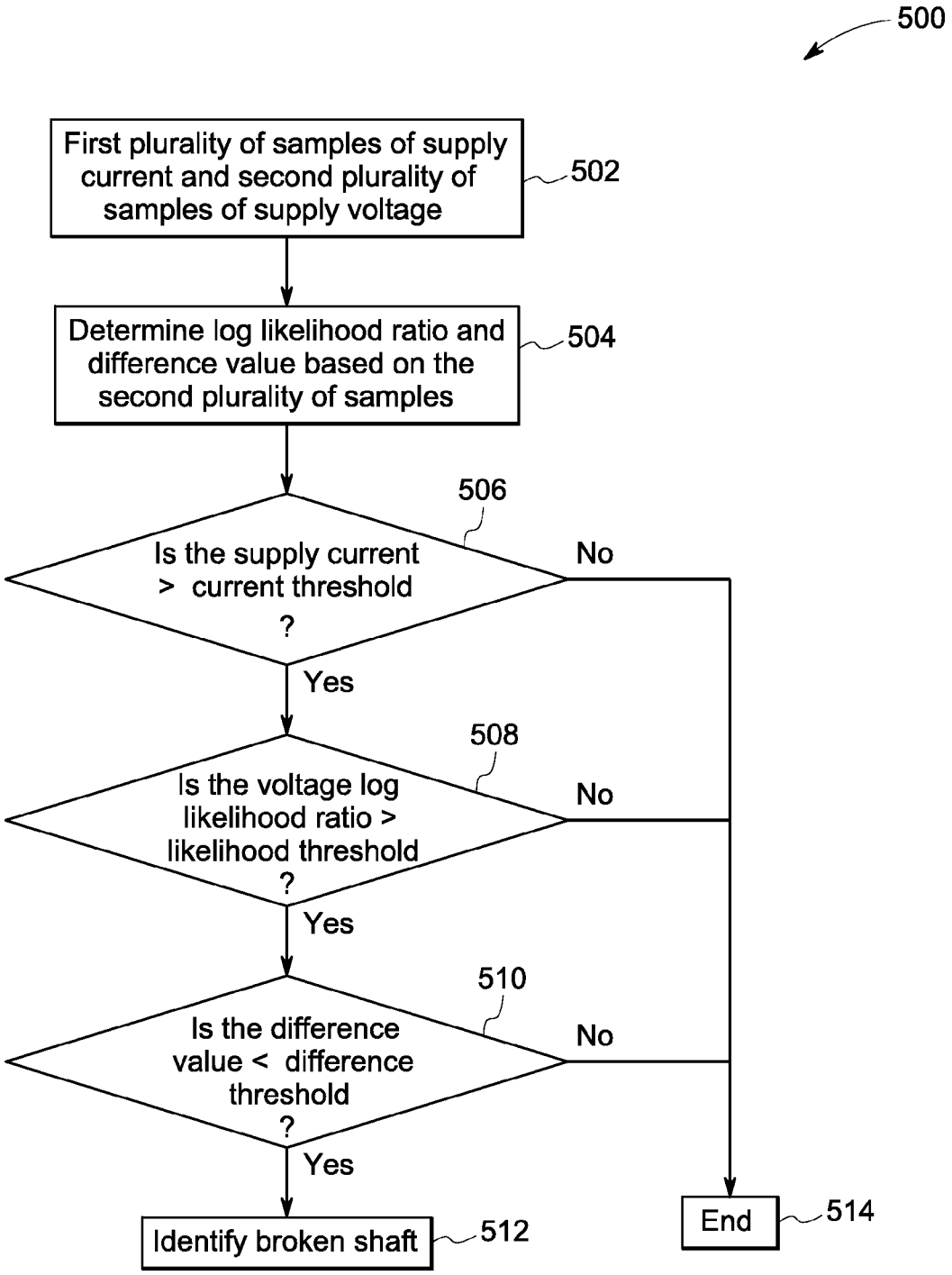
FIG. 5 is a flow chart illustrating a method for identification of a broken shaft condition of an electrical device in accordance with an exemplary embodiment.

FIG. 5 is a flow chart 500 illustrating a method for identification of a broken shaft condition of an electrical device in accordance with an exemplary embodiment. A first plurality of samples of supply current and a second plurality of samples of supply voltage are received from a plurality of sensors 502. A log likelihood ratio and a difference value are determined based on the second plurality of samples of the supply voltage 504. The determination of the log likelihood ratio and the difference value are explained in greater detail with reference to a subsequent figure. The first plurality of samples of the supply current are compared with a current threshold 506 to verify if the centrifugal pump is switched off or operating at no load condition. In one exemplary embodiment, the current threshold is 15 A. When the first plurality of samples of the supply current are less than the current threshold, the processing is terminated and hence the measured operating condition is not determined 514. When the first plurality of samples of the supply current are greater than the current threshold, then the log likelihood ratio is compared with a likelihood threshold 508. In the exemplary embodiment, the likelihood threshold has a value equal to thirty. When the log likelihood value is less than the likelihood threshold, the processing is terminated and hence the measured operating condition is not determined 514. When the log likelihood ratio is greater than the likelihood threshold, then the difference value is compared with a difference threshold 510. In an exemplary embodiment, the difference threshold is −60 Volts. When the difference value is less than the difference threshold, a broken shaft condition is determined 512. Otherwise, the processing is concluded and the measured operating condition is not determined 514.

Figure 6:
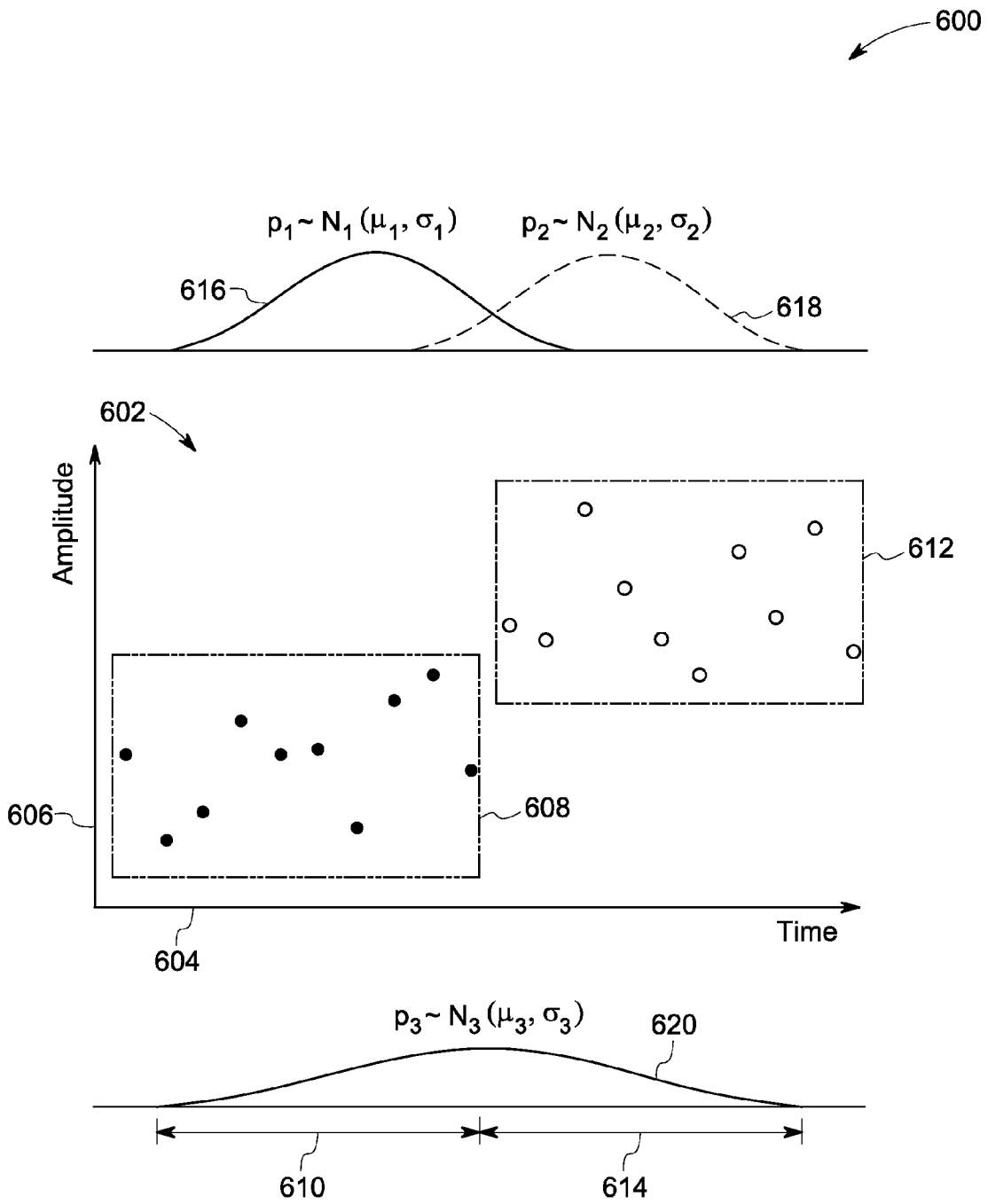
FIG. 6 is a schematic illustration for determining a log likelihood ratio in accordance with an exemplary embodiment of FIG. 5.

FIG. 6 is a schematic illustration 600 used to determine a log likelihood ratio in accordance with an exemplary embodiment of FIG. 5. The schematic illustration includes a graph 602 representative of the second plurality of samples of the supply voltage of an electrical device. The x-axis 604 is representative of time and the y-axis 606 is representative of amplitude. The second plurality of samples of the supply voltage includes a first set of samples 608 generated during a first duration 610 and a second set of samples 612 generated during a second duration 614. A first probability distribution 616 is used to characterize the first set of samples 608 and a second probability distribution 618 is used to characterize the second set of samples 612 and, a third probability distribution 620 is used to characterize the second plurality of samples. In one exemplary embodiment, the first probability distribution 616, the second probability distribution 618, and the third probability distribution 620 are normal distribution fits for the first set of samples 608, the second set of samples 612, and the second plurality of samples respectively.

The first probability distribution 616 is represented by $p_1$ as:

$$p_1 \sim N_1(\mu_1, \sigma_1) \tag{1}$$

where, $N_1$ is representative of a normal distribution, $\mu_1$ is representative of a mean of the first probability distribution 616, and $\sigma_1$ is representative of a standard deviation of the first probability distribution 616. The second probability distribution 618 is represented by $p_2$ as:

$$p_2 \sim N_2(\mu_2, \sigma_2) \tag{2}$$

where $N_2$ is representative of a normal distribution, $\mu_2$ is representative of a mean of the second probability distribution 618, and $\sigma_2$ is representative of a standard deviation of the second probability distribution 618. The third probability distribution 620 is represented by $p_3$ as:

$$p_3 \sim N_3(\mu_3, \sigma_3) \tag{3}$$

where $N_3$ is representative of a normal distribution, $\mu_3$ is representative of a mean of the third probability distribution 620, and $\sigma_3$ is representative of a standard deviation of the third probability distribution 620.

With reference to the probability distributions 616, 618, 620, alternate hypotheses $H_1$ and $H_2$ corresponding to a change in the probability distributions (from $p_1$ to $p_2$) and assuming no change in the distribution ($p_3$) are considered. A metric T for the log likelihood ratio distinguishing hypothesis $H_1$ from the hypothesis $H_2$ is represented by:

$$T = \sum_{i=1}^{m} \ln \frac{p_1(x_i)}{p_3(x_i)} + \sum_{i=m+1}^{N} \ln \frac{p_2(x_i)}{p_3(x_i)} \tag{4}$$

where m is a sample at which the distribution change is hypothesized, and n is a total number of samples in the second plurality of samples. The term $p_1(x_i)$, $p_1(x_i)$, and $p_1(x_i)$ are the probability of sample $x_i$ determined by the probability distributions $p_1$, $p_2$, and $p_3$ respectively. When the metric T is greater than the likelihood threshold, the hypothesis $H_1$ corresponding to the change in the distribution is determined. When the metric T is less than or equal to the likelihood threshold, the hypothesis $H_2$ corresponding to no-change in the distribution is determined. The difference value is a difference between the mean of the first probability distribution ($\mu_1$) and the mean of the second probability distribution ($\mu_2$).

Figure 7:
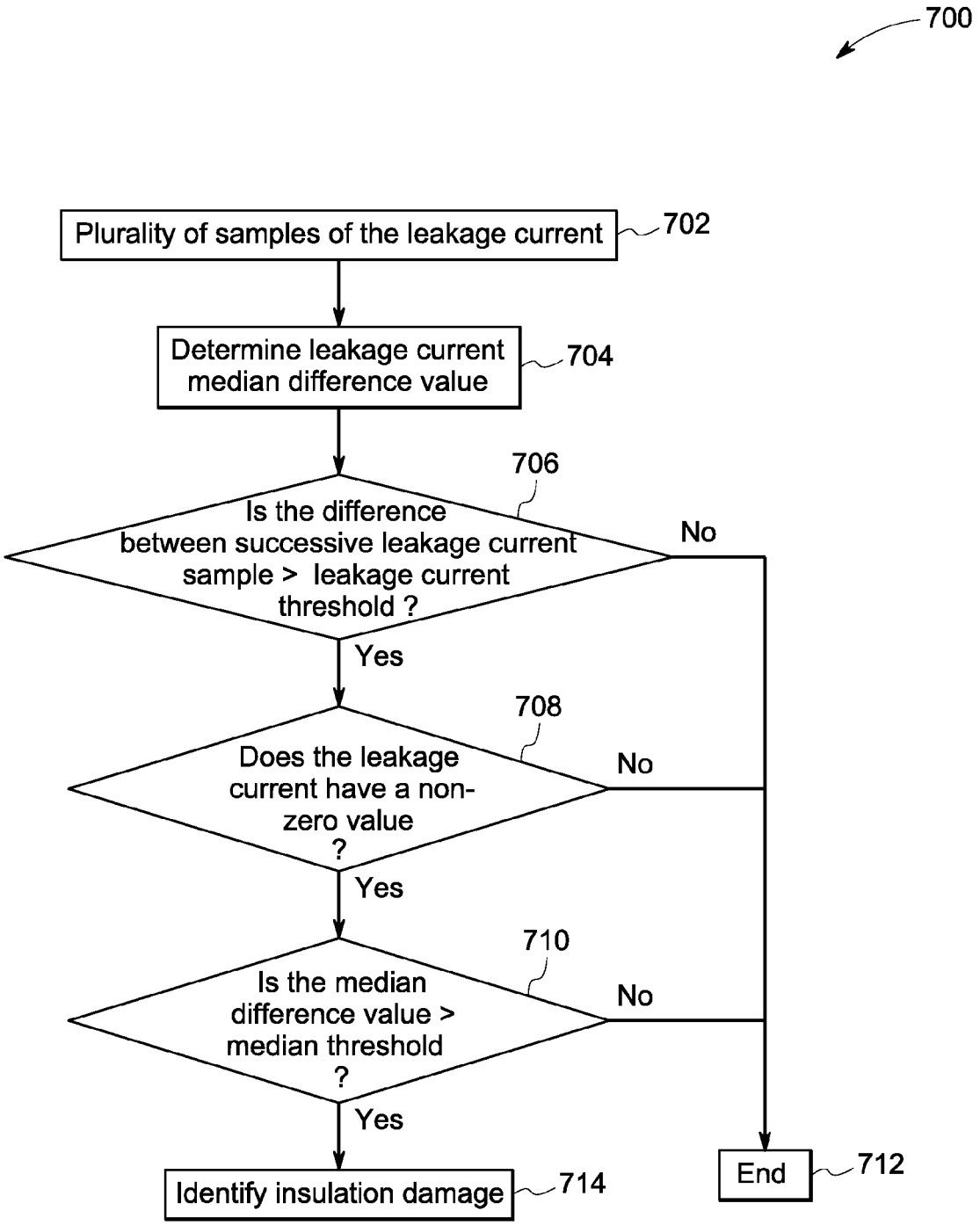
FIG. 7 is a flow chart illustrating a method for identification of an insulation damage in an electrical device in accordance with an exemplary embodiment.

FIG. 7 is a flow chart 700 illustrating a method for identification of insulation damage in an electrical device in accordance with an exemplary embodiment. A plurality of samples of leakage current are received from a plurality of sensors 702. A median difference value of the leakage current is determined 704 based on the plurality of samples of the leakage current. An exemplary embodiment for determining the median difference value of the leakage current is explained in greater detail below. A difference between two successive sample values of the leakage current is compared with a leakage current threshold 706. If the difference between two successive sample values of the leakage current is less than the leakage current threshold, the processing is terminated and hence the measured operating condition is not determined 712. If the difference between two successive sample values of the leakage current is greater than the leakage current threshold, the plurality of samples of the leakage current are checked to verify the plurality of samples of the leakage current have non-zero value 708. If the plurality of samples of the leakage current have a zero value, the processing is terminated and hence the measured operating condition is not determined 712. If the plurality of samples of the leakage current have a non-zero value, then the median difference value is compared with a median threshold 710. In the one embodiment, the median difference threshold is 1 mA. When the median difference value is less than the median threshold, the processing is terminated and hence the measured operating condition is not determined 712. When the median difference value is greater than the median threshold, the measured operating condition is determined as an insulation damage 714.

For determining a median difference value, one set of samples from the plurality of samples of the leakage current are considered initially with reference to a time axis. A first median value of the one set of samples is then determined. Another set of samples from the plurality of samples of the leakage current, is considered subsequently with reference to the time axis. Then a second median value of the other set of samples is determined. Thereafter, a difference between the first median value and the second median value is determined. In an exemplary embodiment, the number of samples considered in the one set of samples and the other set of samples is equal to ten.

Figure 8:
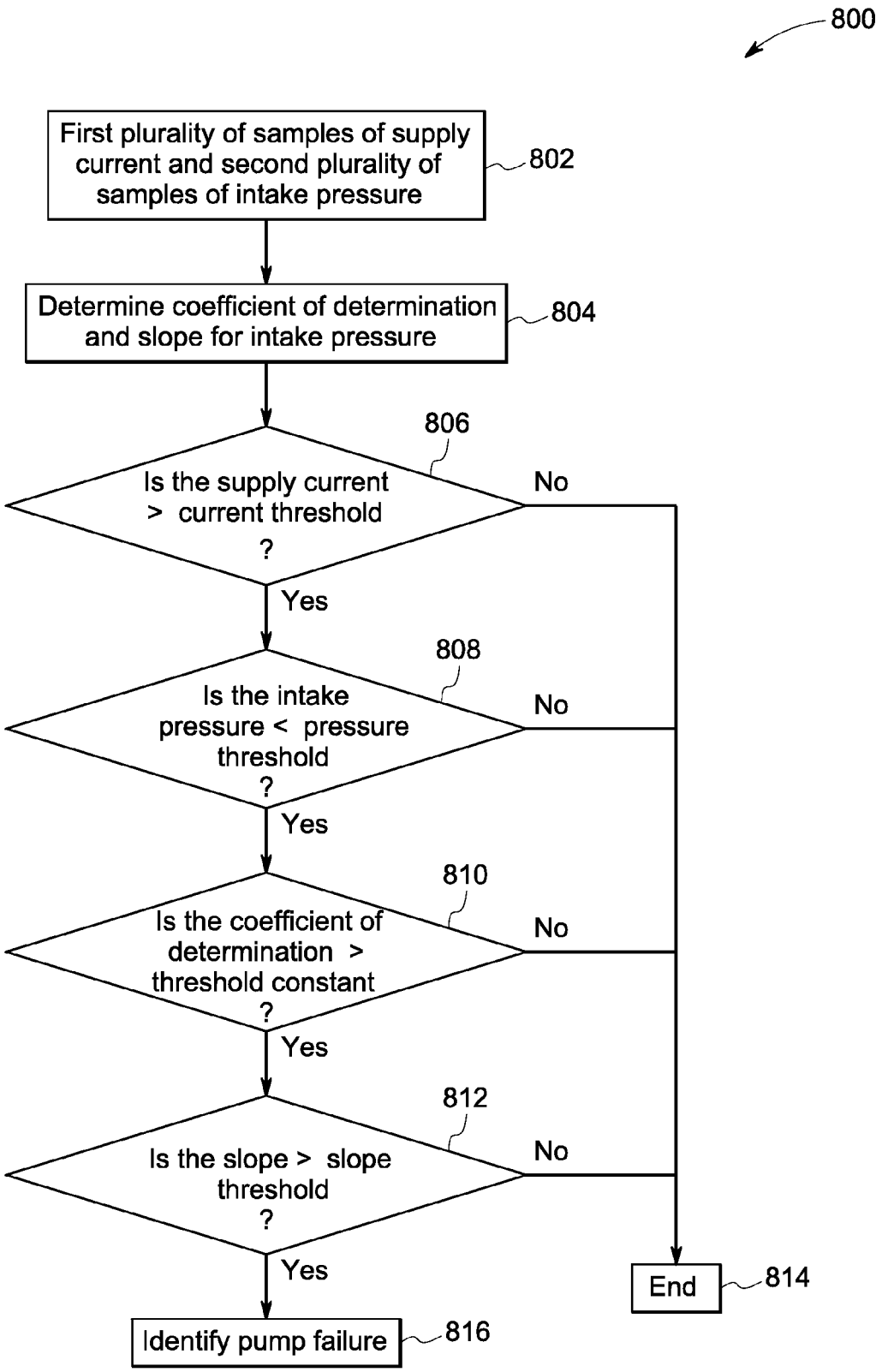
FIG. 8 is a flow chart illustrating a method for identification of a pump failure condition of an electrical device in accordance with an exemplary embodiment.

FIG. 8 is a flow chart 800 illustrating a method for identification of a pump failure condition of an electrical device in accordance with an exemplary embodiment. A first plurality of samples such as supply current and a second plurality of samples such as intake pressure are received from a plurality of sensors 802. A coefficient of determination and a slope corresponding to the second plurality of samples of the intake pressure are determined 804. The determination of the coefficient of determination and the slope are explained in greater detail in a subsequent paragraph.

The first plurality of samples of the supply current is then compared with a current threshold 806. If the first plurality of samples of the supply current are less than the current threshold, the processing is terminated 814 and hence the measured operating condition is not determined. In an exemplary embodiment, the current threshold is equal to 15 A. When the first plurality of samples of the supply current is greater than the current threshold, the second plurality of samples of the intake pressure is then compared with a pressure threshold 808. When the second plurality of samples of the intake pressure are greater than the pressure threshold, the processing is terminated and hence the measured operating condition is not determined 814. In an exemplary embodiment, the pressure threshold is equal to 200 bars. When the second plurality of samples of the intake pressure are less than the pressure threshold, the coefficient of determination is then compared with a threshold constant 810. In one exemplary embodiment, the threshold constant is equal to 0.8. When the coefficient of determination is greater than the threshold constant, then the slope value is compared with a slope threshold 812. In one exemplary embodiment, the slope threshold is equal to 10 bars per day. When the slope value is greater than the slope threshold, a pump failure is determined 816 as the measured operating condition. When the slope value is less than the slope threshold, the processing is terminated 814 and hence the measured operating condition is not determined.

For determining the coefficient of determination, the second plurality of samples $\{p_1\}$ of the intake pressure are used to determine a linear regression generating a corresponding pressure sample estimate $\{f_i\}$. The coefficient of determination corresponding to the intake pressure is represented by:

$$R^2 = 1 - \frac{\sum_i (p_i - \bar{p})^2}{\sum_i (p_i - f_i)^2}$$

where $R^2$ is representative of the coefficient of determination, $p_i$ is representative of ith sample from the second plurality of samples of the intake pressure, $\bar{p}$ is a mean of the second plurality of samples, $f_i$ is representative of ith sample of the plurality of samples of the intake pressure.

Figure 9:
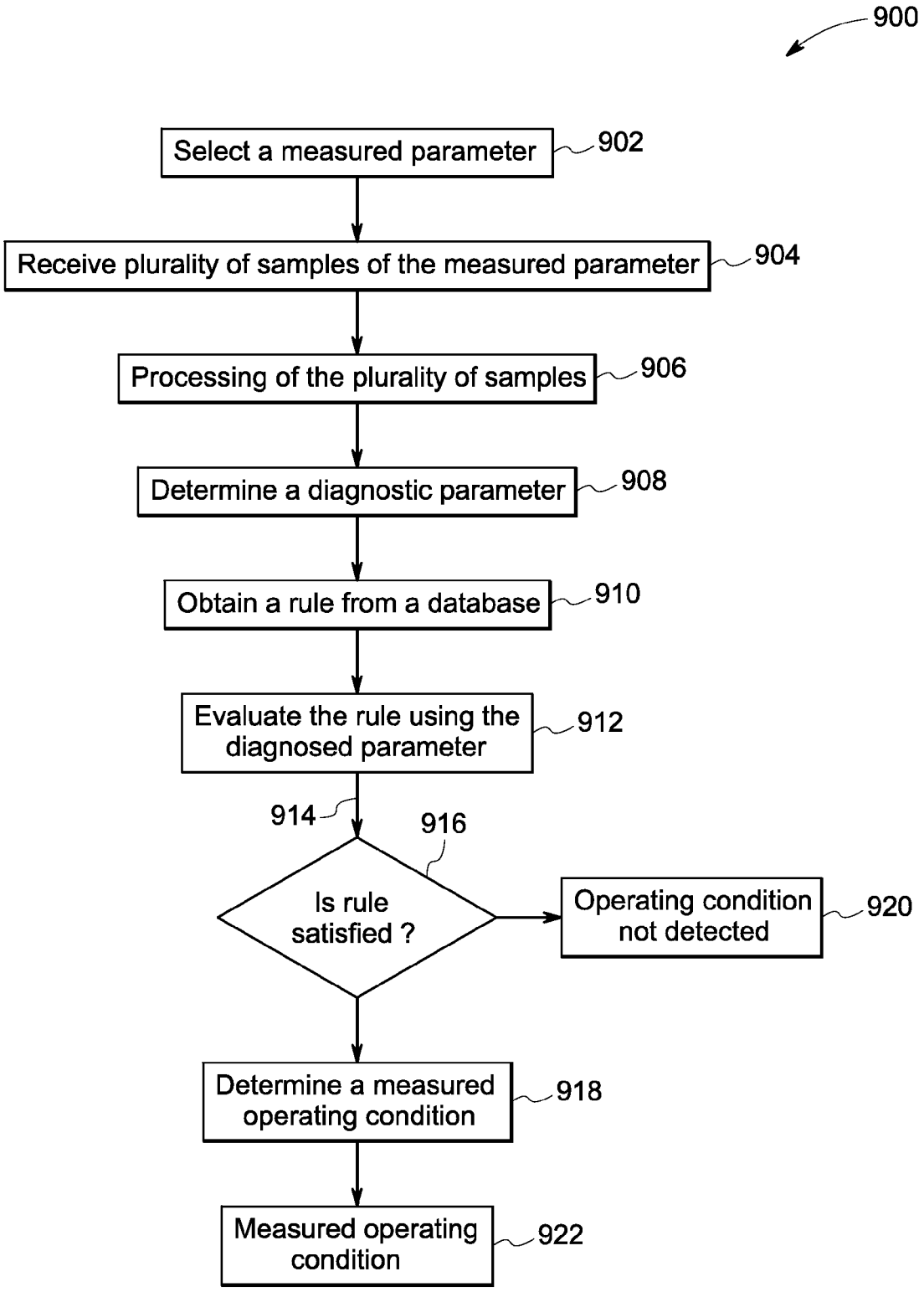
FIG. 9 is a flow chart illustrating a method for detection of a measured operating condition of an electrical device in accordance with an exemplary embodiment.

FIG. 9 is a flow chart 900 illustrating a method for determining a measured operating condition of an electrical device in accordance with an exemplary embodiment. A parameter from a plurality of parameters including vibration, supply voltage, supply current, intake pressure, is selected 902. A plurality of samples of the selected parameter are received 904. The plurality of samples are processed 906 to remove one or more invalid samples from the plurality of samples. A diagnostic parameter is determined 908 based on a remaining number of samples.

A rule from a plurality of rules stored in a database, is obtained based on the diagnostic parameter 910. The method further involves evaluating whether the determined diagnostic parameter satisfies the obtained rule 912. The rule is evaluated to generate a binary output 914. The binary output is checked to determine if the obtained rule is satisfied 916. When the evaluation satisfies the obtained rule, a measured operating condition is determined 918. The determination of the measured operating condition 922 enables diagnosis and maintenance of the electrical device. When the evaluation does not satisfy the obtained rule, the measured operating condition is not determined 920.

It is to be understood that not necessarily all such objects or advantages described above may be achieved in accordance with any particular embodiment. Thus, for example, those skilled in the art will recognize that the systems and techniques described herein may be embodied or carried out in a manner that achieves or improves one advantage or group of advantages as taught herein without necessarily achieving other objects or advantages as may be taught or suggested herein.

While the technology has been described in detail in connection with only a limited number of embodiments, it should be readily understood that the invention are not limited to such disclosed embodiments. Rather, the technology can be modified to incorporate any number of variations, alterations, substitutions or equivalent arrangements not heretofore described, but which are commensurate with the spirit and scope of the claims. Additionally, while various embodiments of the technology have been described, it is to be understood that aspects of the inventions may include only some of the described embodiments. Accordingly, the inventions are not to be seen as limited by the foregoing description, but are only limited by the scope of the appended claims.

What is claimed as new and desired to be protected by Letters Patent of the United States is:

1. A method comprising:

selecting a measured parameter from a sensor coupled to a subsurface electrical device;

obtaining a plurality of samples for the measured parameter;

removing at least one invalid sample from the plurality of samples of the measured parameter to generate a remaining number of samples, wherein the at least one invalid sample is based on a predefined sample criteria;

computing a diagnostic parameter based on the remaining number of samples from the plurality of samples, if the remaining number of samples is greater than a predefined threshold number, otherwise terminating the method;

obtaining a rule from a plurality of rules stored in a database, based on the diagnostic parameter, wherein the rule is indicative of a standard operating condition of the subsurface electrical device;

evaluating whether the computed diagnostic parameter satisfies the obtained rule, to generate an output; and determining a measured operating condition of the subsurface electrical device based on the output.

2. The method of claim 1, wherein the predefined sample criteria comprises a parameter range and not-a-number criteria.

3. The method of claim 1, wherein the measured parameter comprises a plurality of measured parameters comprising vibration, supply current, intake pressure, supply voltage, and leakage current.

4. The method of claim 3, wherein the computed diagnostic parameter comprises a plurality of diagnostic parameters comprising an amplitude, a difference value, a mean, a median, a variance, a log likelihood ratio, a slope value, and a coefficient of determination, of each measured parameter from the plurality of measured parameters.

5. The method of claim 4, wherein the standard and measured operating conditions of the subsurface electrical device, comprises a plurality of operating conditions comprising an excessive vibration, an emulsion pattern, a broken shaft fault, a motor insulation damage, and a pump failure.

6. The method of claim 5, wherein the rule for determining the excessive vibration comprises:

a comparative statement to verify if the amplitude of the vibration is less than a first amplitude threshold; and a comparative statement to verify if the amplitude of the vibration is greater than a second amplitude threshold.

7. The method of claim 5, wherein the rule for determining the emulsion pattern comprises:

a comparative statement to verify if the supply current is greater than a current threshold;

a comparative statement to verify if the variance of the supply current is greater than a current variance threshold; and a comparative statement to verify if the variance of the intake pressure is greater than a pressure variance threshold.

8. The method of claim 5, wherein the rule for determining the broken shaft fault comprises:

a comparative statement to verify if the supply current is greater than a current threshold;

a comparative statement to verify if the log likelihood ratio is greater than a likelihood threshold; and a comparative statement to verify if the difference value is less than a difference threshold.

9. The method of claim 5, wherein the rule for determining the motor insulation damage comprises:

a comparative statement to verify if a difference between two successive sample values of the leakage current is less than a leakage current threshold;

a comparative statement to verify if the leakage current is a non-zero value; and a comparative statement to verify if a difference between a first median of one set of sample values of the leakage current and a second median of another set of sample values of the leakage current is greater than a median threshold.

10. The method of claim 5, wherein the rule for determining the pump failure comprises:

a comparative statement to verify if the supply current is greater than a current threshold;

a comparative statement to verify if the intake pressure is less than a pressure threshold;

a comparative statement to verify if the coefficient of determination of the intake pressure is greater than a threshold constant; and a comparative statement to verify if the slope value of a linear approximation of the intake pressure is greater than a slope threshold.

11. The method of claim 1, wherein the output comprises a binary value.

12. A system comprising:

at least one processor;

a memory communicatively coupled to the at least one processor;

a database having a plurality of rules, stored in the memory, wherein the rule is indicative of a standard operating condition of a subsurface electrical device; and an analytic engine stored in the memory and executable by the at least one processor and configured to:

select a measured parameter from a sensor coupled to the subsurface electrical device;

obtain a plurality of samples for the measured parameter;

remove at least one invalid sample from the plurality of samples based on a predefined sample criteria to generate a remaining number of samples;

compute a diagnostic parameter based on the remaining number of samples from the plurality of samples, when the remaining number of samples is greater than a predefined threshold number, otherwise terminate the execution by the at least one processor;

obtain a rule from the plurality of rules stored in the database, based on the diagnostic parameter;

evaluate whether the computed diagnostic parameter satisfies the obtained rule, to generate an output; and determine a measured operating condition of the subsurface electrical device based on the output.

13. The system of claim 12, wherein the analytic engine is configured to receive the measured parameter comprising a plurality of measured parameters including vibration, supply current, intake pressure, supply voltage, and leakage current, and compute the diagnostic parameter comprising a plurality of diagnostic parameters including an amplitude, a difference value, a mean, a median, a variance, a log likelihood ratio, a slope value, and a coefficient of determination of each measured parameter.

14. The system of claim 13, wherein the analytic engine is configured to determine the standard and measured operating conditions of the subsurface electrical device, comprising a plurality of operating conditions comprising an excessive vibration, an emulsion pattern, a broken shaft fault, a motor insulation damage, and a pump failure.

15. The system of claim 14, wherein the analytic engine is configured to evaluate the rule for determining the excessive vibration comprising:

a comparative statement to verify if the amplitude of the vibration is less than a first amplitude threshold; and a comparative statement to verify if the amplitude of the vibration is greater than a second amplitude threshold.

16. The system of claim 14, wherein the analytic engine is configured to evaluate the rule for determining the emulsion pattern comprising:

a comparative statement to verify if the supply current is greater than a current threshold;

a comparative statement to verify if the variance of the supply current is greater than a current variance threshold; and a comparative statement to verify if the variance of the intake pressure is greater than a pressure variance threshold.

17. The system of claim 14, wherein the analytic engine is configured to evaluate the rule for determining the broken shaft fault comprising:

a comparative statement to verify if the supply current is greater than a current threshold;

a comparative statement to verify if the log likelihood ratio is greater than a likelihood threshold; and a comparative statement to verify if the difference value is less than a difference threshold.

18. The system of claim 14, wherein the analytic engine is configured to evaluate the rule for determining the motor insulation damage comprising:

a comparative statement to verify if a difference between two successive sample values of the leakage current is less than a leakage current threshold;

a comparative statement to verify if the leakage current is a non-zero value; and a comparative statement to verify if a difference between a first median of one set of sample values of the leakage current and a second median of another set of sample values of the leakage current is greater than a median threshold.

19. The system of claim 14, wherein the analytic engine is configured to evaluate the rule for determining the pump failure comprising:

a comparative statement to verify if the supply current is greater than a current threshold;

a comparative statement to verify if the intake pressure is less than a pressure threshold;

a comparative statement to verify if the coefficient of determination of the intake pressure is greater than a threshold constant; and a comparative statement to verify if the slope value of a linear approximation of the intake pressure is greater than a slope threshold.

20. The system of claim 12, wherein the analytic engine is configured to generate the output comprising a binary value.

21. A non-transitory computer readable medium encoded with a program to instruct at least one processor to:

select a measured parameter from a sensor coupled to a subsurface electrical device;

obtain a plurality of samples for the measured parameter;

remove at least one invalid sample from the plurality of samples of the measured parameter to generate a remaining number of samples, wherein the at least one invalid sample is based on a predefined criteria;

compute a diagnostic parameter based on the remaining number of samples from the plurality of samples, if the remaining number of samples is greater than a predefined threshold number, otherwise terminate the program;

obtain a rule from a plurality of rules stored in a database, based on the diagnostic parameter, wherein the rule is indicative of a standard operating condition of the subsurface electrical device;

evaluate whether the computed diagnostic parameter satisfies the obtained rule, to generate an output; and determine a measured operating condition of the subsurface electrical device based on the output.

* * * * *